US006884127B2

(12) United States Patent
Quillet et al.

(10) Patent No.: US 6,884,127 B2
(45) Date of Patent: Apr. 26, 2005

(54) LINKING DEVICE BETWEEN A CABLE AND CONTACT ELEMENT

(75) Inventors: Thierry Quillet, La Milesse (FR); Daniel Gloaguen, Le Mans (FR)

(73) Assignee: Souriau, Versailles Cedex (FR)

( * ) Notice: Subject to any disclaimer, the term of this patent is extended or adjusted under 35 U.S.C. 154(b) by 0 days.

(21) Appl. No.: 10/622,963

(22) Filed: Jul. 17, 2003

(65) Prior Publication Data

US 2004/0137801 A1 Jul. 15, 2004

(30) Foreign Application Priority Data

Jul. 17, 2002 (FR) ..... 02 09090

(51) Int. Cl.[7] ..... H01R 4/10
(52) U.S. Cl. ..... 439/877; 439/886
(58) Field of Search ..... 439/877, 882, 439/886, 978, 878

(56) References Cited

U.S. PATENT DOCUMENTS 3,210,720 A * 10/1965 Harris, Jr. ..... 439/518
3,842,487 A 10/1974 Hartz
4,704,498 A * 11/1987 Gregorac ..... 174/79
4,813,893 A * 3/1989 Sindlinger ..... 439/730
4,915,657 A * 4/1990 Derry ..... 439/879
5,399,110 A * 3/1995 Morello et al. ..... 439/879
5,408,743 A * 4/1995 Tournier et al. ..... 29/863
5,498,838 A * 3/1996 Furman ..... 174/74 R
6,004,172 A * 12/1999 Kerek ..... 439/891
6,015,953 A * 1/2000 Tosaka et al. ..... 174/79
6,641,444 B1 * 11/2003 Hanazaki et al. ..... 439/877

FOREIGN PATENT DOCUMENTS

DE 29903301 5/1999
FR 2683396 5/1993

* cited by examiner

*Primary Examiner*—Hae Moon Hyeon
(74) *Attorney, Agent, or Firm*—Boyle, Fredrickson, Newholm, Stein & Gratz, S.C.

(57) ABSTRACT

In a linking device (1) between strands (6) of a cable (3) and a contact element (4) comprising a hollow intermediate tube (9) provided with a channel, the tube has a first aperture (11) used for the insertion of one end (2) of the cable into the channel and a second aperture (17) to cooperate with the contact element. The tube is a solid part like the contact element. It is made of a material having a coefficient of expansion similar to that of the strands. This tube enables connexion between strands with a coefficient of expansion different from that of the contact element with which they have to be connected.

26 Claims, 1 Drawing Sheet

LINKING DEVICE BETWEEN A CABLE AND CONTACT ELEMENT

BACKGROUND OF THE INVENTION

1. Field of the Invention

An object of the invention is a linking device between a termination of a cable and a contact element. It can be used more particularly in the field of interconnections in aeronautics. The cable comprises metal strands held together in a cable sheath. These strands have to be connected to the connecting element so that it can provide continuity of the electrical signal at the junction between the cable and a corresponding device. However, the materials of which they are made have different natures and different physical properties. Now, such elements and cables undergo major physical stresses in terms of pressure and temperature variations owing to their use in onboard machinery. Consequently, it can happen that it becomes impossible to guarantee a permanent connection. The invention proposes an approach implementing an intermediate element used to compensate for the effects of temperature variations in particular.

2. Description of the Prior Art

In the prior art, there is a known contact element designed to receive a termination of a cable in a receiver of this contact element. The receiver generally forms a cylindrical barrel or sleeve into which a bared portion of the cable may be inserted. The sleeve is generally designed with a flared portion at an outlet point of this sleeve so that it can also receive a non-bared portion of the cable. The cable is held within the sleeve because this sleeve is then crimped around the bared portion, and around the non-bared portion of the cable.

This contact element generally has a contact end opposite the end giving access to the aperture that opens into the sleeve. This contact end generally has an elongated shape and has either a female termination or a male termination. The contact element is made in one piece: for example it is obtained by machining or turning. It is made out of copper and forms a solid piece.

In aeronautical applications and for reasons of weight, cables with copper strands cannot be used. This is why it is the use of cables with aluminum strands that is envisaged. Such strands have good characteristics of connectivity and contact resistance, and they weigh less than the copper strands.

To improve the contact made between the strands of the cable and the inner walls of the sleeve into which they are inserted, these inner walls are gold-plated beforehand. The problem posed by this gold-plating step is that, to be able to control the homogeneity of the gold-plating deposited on the inner walls of the sleeve when it has a diameter of about the millimeter, it is necessary to provide for a via hole that crosses the thickness of the contact and reaches the deepest level of the sleeve. The presence of this inspection hole raises a problem. Even if it ensures the quality of the deposited gold-plate layer, this hole subsequently has to be plugged so as not to impair the impervious sealing of the connection. The plugging of the inspection hole entails an additional step and is therefore a constraint. This plugging is obligatory to prevent the end of the cable inside the sleeve from being damaged by corrosion.

Finally, to make contact, as is the case in the prior art, the sleeve is crimped at a first level on the bared strands of the cable and at a second level on the sheath of the cable. The first crimping provides for electrical connection and, at the same time, mechanical strength. The second crimping provides for the impervious sealing of the connection at the sleeve aperture.

Owing to the conditions in which the connections are placed, i.e. the substantial and rapid temperature variations to which they are subjected, the differences in expansion coefficients between the aluminum and the copper cause a relaxation of the contact pressure and, at the same time, an increase in contact resistance that is detrimental to the quality of the connection.

SUMMARY OF THE INVENTION

It is an object of the invention to resolve the problems raised by proposing a reliable connection that can maintain its qualities even when subjected to such variations of pressure and temperature. In the solution implemented in the invention, a contact element is made in two parts. A first part is constituted by the male or female machined or bar-turned contact having a solid end. As for the second part of the contact, it is constituted by a tube into which the first part can be forced-fitted. The first part is pushed into a first open end of the tube. The advantage of the structure is that enables the two parts to be made of different materials. These two parts are solid and may be obtained by machining or turning. The contact set up between these two parts is reliable inasmuch as it is a mechanically stressed contact.

According to the invention, the second part forming a tube may receive at the second end the strands of the cable and also a portion of the non-bared cable. This second end is crimped on the strands of the cable. But here, since the second part is made of a material whose nature is similar to the nature of the strands, at least in terms of expansion coefficients, when this connection is subjected to the physical variations described here above, the two elements evolve in the same way with respect to each other and therefore remain in permanent contact. This approach gives an adequate mechanical and electrical link. During thermal shocks, there is no drop in contact pressure between the strands and the walls of the tube. This improves the contact resistance and favors the transmission of the signal.

Another advantage given by the invention is that if it is desired to further improve the quality of the connection between the strands and a tube, it is very easy to protect the inner walls of the tube with a layer of gold-plating for example. This layer can be very easily deposited and checked, since the tube thus prepared is open at both ends before it is mounted.

An object of the invention is a connection device between a contact element and strands of a cable, the strands of the cable being made out of a material with a coefficient of expansion that is different from a coefficient of expansion of the contact element, the device comprising an intermediate tube cooperating respectively with the contact element and the strands, this tube having rigidity similar to than that of the contact element and having a coefficient of expansion similar to that of the strands, wherein the intermediate tube is covered internally with a ductile and conductive material.

BRIEF DESCRIPTION OF THE DRAWINGS

The invention will be understood more clearly from the following description and the accompanying figures. These figures are given purely by way of an indication and in no way restrict the scope of the invention. Of these figures:

FIG. 1 shows a prior art contact 100. This contact 100 has a shape that is generally elongated along an axis 101. As a first end 102, the contact 100 has an aperture within which an end 104 of the cable 105 is inserted. This end 104 has a first bared terminal portion 106 that allows strands 107 of this cable 105 to appear. The end 104 has a second portion 108 for which the strands 107 are protected by a sheath 109 of this cable 105.

Figure 1:
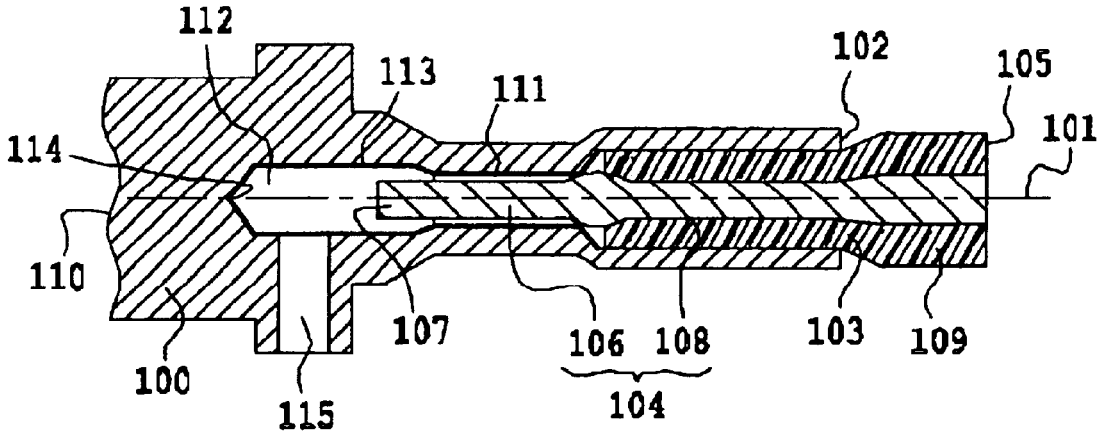
Fig. 1 (Prior Art)
FIG. 1 is a sectional view of the contact to be mounted at the end of a cable according to the prior art.

The contact 100 has a second end 110 in the form of a male or female termination to cooperate with a matching device. The contact 100 is made in one piece out of a single material such as copper for example, while the strands 107 are made of aluminum. To improve the contact between the inner walls 111 of the sleeve 112 opening at the level of the aperture 103, the layer 113 is deposited on the walls 111. This layer comprises for example gold. This layer 113 is deposited in the sleeve 112 by injection. The sleeve has an inspection hole 115 to verify the homogeneity of the deposit and thus ensure that the layer is not solely a deposit concentrated at the bottom 114 of the sleeve. This inspection hole is shaped so as to leave an axis between the inside of the sleeve 112 and the outside of the contact 100. The surplus material deposited to form the layer is removed through this inspection hole.

A contact of this kind has the drawbacks described further above.

Figure 2:
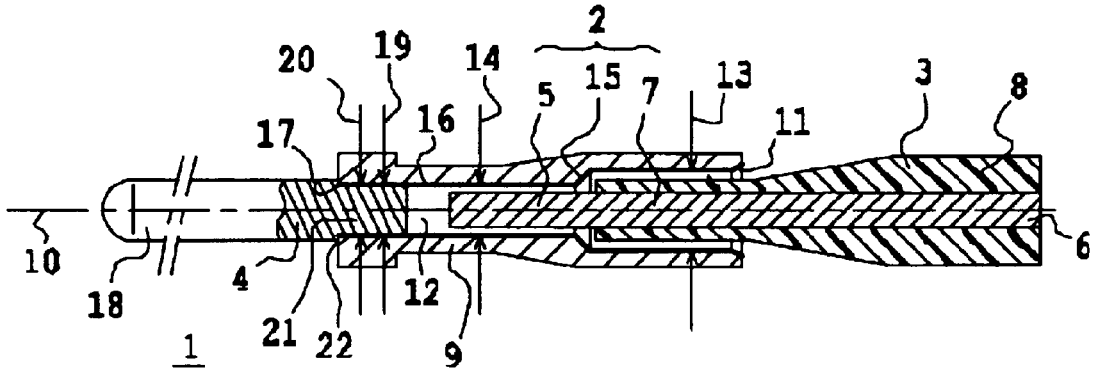
FIG. 2 is a sectional view of a connection device according to the invention.

FIG. 2 shows a connection device 1 according to the invention. This device 1 connects one end 2 of the cable 3 to a contact element 4.

The end 2 has a first end of portion 5 letting through strands 6 of this cable 3. Furthermore, the end 2 has a second portion 7 for which the strands 6 are protected by a sheath 8 of the cable 3. The end 2 corresponds to the cable length inserted into an intermediate tube 9 of the device 1.

The cable 3 is elongated along an axis 10. In FIG. 2, the end 2 is inserted into an aperture 11 of the tube 9, on the right-hand side of this tube. The aperture 11 opens into an inner channel 12 that goes through the tube 9. This channel extends in parallel to the axis 10. The inner channel is, for example, cylindrical. It may have several sections with different inner diameters. For example, at the aperture 11, the tube has a first section with an inner diameter 13, and the second section with an inner diameter 14. The diameter 14 is smaller than the diameter 13. The second section with the diameter 14 is in a central position inside the tube. When the end 2 is inserted, the first portion 5 is presented in a second section with a diameter 14, while the second portion is presented in the first section with a diameter 13. Indeed, the sheath 8 abuts an inner shoulder 15 defined between the first section 13 and the second section 14.

To keep the end 2 in the tube 9, the sections 13 and 14 respectively are crimped around portions 7 and 5 respectively. This end is therefore held by a double crimping. The crimping of the second section with a diameter 14 about the bared strands 6 of the first portion 5 provides both for the mechanical holding of the end 2 and for electrical connection between the inner walls of the channel 12 with the strands 6. The crimping of the first section with the inner diameter 13 about the second portion 7 of the end 2 also fulfils a mechanical holding function and furthermore ensures the impervious sealing of the connection on the aperture 11 side.

The cable 3 has aluminum strands for example and is surrounded by an insulator sheath made of plastic. The intermediate tube 9 for its part is, for example, machined or else obtained by being bar-turned out of a solid material such as for example aluminum. Since the materials constituting the strands 6 are similar to those of the tube 9, they have similar coefficients of expansion. In other words, when they are subjected to the same strains, they react in the same way. This means that if the contact pressure and the electrical resistance of the connection meet certain criteria under certain conditions, then these criteria will be met in every type of condition.

To improve the contact pressure, even during variations in external conditions, and also to improve the contact resistance, the inner walls of the channel 12 may be lined with a layer 16 made of a ductile and conductive material. This layer 16 may comprise, for example, silver, gold or tin. The deposition of this layer 16 is a very easy operation since the access to the inner walls of the channel 12 is allowed on the aperture 11 side as well as at a second aperture 17, on the left-hand side of this tube 9. In FIG. 2, the apertures 11 and 17 are parallel to each other and orthogonal to the axis 10.

Once this layer 16 has been deposited on the tube 9, this tube can be mounted on the cable and then provided with its contact element 4.

The contact element 4 is tube-shaped. At one end it has a male or female connection means 18 to co-operate with a matching device. In the examples shown in FIG. 2, this connection means 18 is a nipple. The contact element 4 is obtained, for example, by machining in a solid material such as copper. Indeed, copper shows high-quality conductivity and contact resistance. This limits signal losses at the junction with the matching device.

The contact element 4 is force-fitted into the tube 9. The contact element and the tube are made out of materials having different technical characteristics, especially as regards the coefficient of expansion. Since the strands 6 and the tube 9 have similar coefficients of expansion, the coefficient of expansion of the strands is different from that of the contact element 4. On the contrary, the contact element 4 and the tube 9 have similar rigidity. Each of them forms a solid piece. And since they are both solid parts, when a mechanical contact is set up between them, even if the external variations induce differential expansion values, these variations nevertheless do not prevent the contact pressure from remaining always sufficient to ensure connection.

Indeed, to mount the contact element 4 into the tube 9, the tube is inserted into the second aperture 17, in being directed parallel to the axis 10. At the aperture 17, the channel 12 has a third section whose inner diameter 19 is slightly smaller than an outer diameter 20 of the inserted part 21 of the contact element 4. The totality of the outer rim of the part 21 is stressed on the totality of the inner wall at this third section 19. The fact that the part 21 is inserted by being forced against the inner walls of the channel 12 ensures satisfactory mechanical behavior as well as satisfactory electrical contact.

The inserted part 21 is demarcated by a flange 22 that takes support on an outer rim of a second aperture 17. The presence of this flange 22 provides an additional means to ensure the impervious sealing quality of the connection at the second aperture 17.

In one variant, the part 21 is designed to receive the second end with the aperture 17 in a sleeve of this part 21. In this case, the tube is force-fitted into the sleeve of the part 21.

What is claimed is:

1. Connecting device between a contact element and strands of wire, the strands of wire comprised of a material with a dilation coefficient different from a dilation coefficient of the contact element, the connecting device comprising an intermediate tube cooperating respectively with the contact element and the strands of wire, the intermediate tube having a rigidity similar to that of the contact element, and having a dilation coefficient similar to that of the strands of wire; and a ductile and conductive material disposed between the intermediate tube and the strands of wire.

2. Device according to claim 1 wherein a first end of the intermediate tube is crimped around the strands of the wire, and around a shaft of this wire.

3. Device according to claim 2 wherein the contact element is fixed in force at a second end of the tube.

4. Device according to claim 3 wherein the contact element is comprised of copper.

5. Device according to claim 4 wherein the strands are comprised of aluminum.

6. Device according to claim 5 wherein the tube is comprised of aluminum.

7. Device according to claim 1 wherein the intermediate tube is internally covered with the ductile and conductive material, and the ductile and conductive material is comprised of one of gold, silver or tin.

8. A connector for connecting a stranded wire to a contact comprising:

a tubular housing having a first opening at one end that communicates with a channel therein that has a first width or diameter for receiving one end of the stranded wire therein and having a necked down portion that has a second width or diameter that is narrower than the first width or diameter for receiving a portion of the stranded wire therein, and having a second opening at its other end that communicates with the necked down portion of the channel with the necked down portion of the channel providing a friction fit with the contact when the contact is received in the necked down portion of the channel, wherein an interior surface of the tubular housing defines the channel and is lined with a ductile and electrically conductive material, and wherein the tubular housing is made of a material having an expansion coefficient that is substantially the same as that of the material of the stranded wire.

9. The connector of claim 8 wherein the tubular housing is deformed against the stranded wire when the stranded wire is disposed in the conduit in the tubular housing.

10. The connector of claim 8 wherein the tubular housing is comprised of aluminum and the stranded wire is comprised of aluminum.

11. The connector of claim 8 wherein a force fit is provided between the contact and the tubular housing of the connector.

12. The connector of claim 11 wherein the contact is of one-piece and unitary construction.

13. The connector of claim 8 wherein the contact is comprised of copper.

14. The connector of claim 8 wherein the ductile and electrically conductive lining is comprised of one of gold, silver or tin.

15. A connector for connecting a stranded wire to a contact comprising:

a tubular housing having an opening at one end that communicates with a channel therein that has a first width or diameter for receiving one end of the stranded wire therein and having a necked down portion that has a second width or diameter that is narrower than the first width or diameter for receiving an exposed electrically conductive portion of the stranded wire therein, and having an opening at its other end that communicates with the necked down portion of the channel, wherein the necked down portion of the channel provides a force fit with the contact when the contact is received in the necked down portion of the channel, an electrically conductive liner that is disposed on an interior surface of the tubular housing that defines the channel;

wherein the tubular housing is made of a material having an expansion coefficient that is substantially the same as the expansion coefficient of the material of the stranded wire; and wherein a portion of the tubular housing is crimped against the stranded wire to retain the stranded wire in the channel of the tubular housing.

16. The connector of claim 15 wherein the electrically conductive liner is comprised of one of gold, silver or tin.

17. The connector of claim 15 wherein the contact is of one-piece and unitary construction and made of copper.

18. A connector for connecting a stranded aluminum wire to a copper contact comprising:

an aluminum tubular housing having a pair of openings leading to an interior surface that defines a generally cylindrical channel therein that has a first section with a first diameter and a second section with a second diameter that is different than the first diameter;

a ductile and electrically conductive material lining the interior surface of the aluminum tubular housing that defines the channel;

wherein the stranded aluminum wire is disposed in one of the channel sections and extends through one of the channel openings and and into the other one of the channel sections;

wherein part of the aluminum tubular housing is crimped against the stranded aluminum wire; and wherein the copper contact is disposed in the other one of the channel sections and extends through the other one of the channel openings; and wherein a force fit is provided between the aluminum tubular housing and the copper contact.

19. The connector of claim 18 wherein the ductile and electrically conductive material is comprised of one of gold, silver or tin.

20. The connector of claim 18 wherein the channel is straight.

21. A connector for connecting a stranded wire to a contact comprising:

a straight and elongate metal tube having an interior sidewall that defines a channel therein having a first opening that communicates with a first section of the channel of a first diameter and having a second opening that communicates with a second section of the channel of a second diameter that is different than the first diameter wherein the contact extends through one of the openings into one of the first and second sections of the channel and the stranded wire extends through the other one of the openings into the other one of the first and second sections of the channel;

an electrically conductive material that is more ductile than the tube, the electrically conductive material disposed in the channel and located between the tube and the stranded wire; and wherein the tube is made of a material having an expansion coefficient that is substantially the same as the expansion coefficient of the stranded wire.

22. The connector of claim 21 wherein the channel extends uninterrupted from the first opening to the second opening.

23. The connector of claim 22 wherein the channel is substantially straight.

24. The connector of claim 21 wherein the electrically conductive material comprises a lining carried by the interior sidewall that defines the channel inside the tube.

25. A connector for connecting a stranded wire to a contact comprising:

an elongate tube having an interior sidewall that defines a channel therein that extends along a substantially straight line, the channel having a pair of openings with one opening disposed at one end of the tube and the other opening disposed at the opposite end of the tube;

wherein the contact is received in one end of the tube and extends through one of the channel openings into the channel;

wherein the stranded wire is received in the other end of the tube and extends through the other one of the openings into the channel;

an electrically conductive material that is more ductile than the tube, the electrically conductive material disposed in the channel and located between the tube and the stranded wire; and wherein the tube is made of a material having an expansion coefficient that is substantially the same as the expansion coefficient of the stranded wire.

26. A connector for connecting a stranded wire to a contact comprising:

an elongate tube having an interior sidewall that defines a channel therein that extends along a substantially straight line, the channel having a pair of openings with one opening disposed at one end of the tube and leading to one section of the channel having one diameter and the other opening disposed at the opposite end of the tube leading to another section of the channel having a different diameter;

wherein the contact is received in one end of the tube and extends through one of the channel openings into one section of the channel;

wherein the stranded wire is received in the other end of the tube and extends through the other one of the openings into the other section of the channel with the stranded wire having a sheathed portion disposed in the other section of the channel and an electrically conductive exposed section extending into the one section of the channel;

an electrically conductive material that is more ductile than the tube, the electrically conductive material disposed in the channel and located between the tube and the stranded wire; and wherein the tube is made of a material having an expansion coefficient that is substantially the same as the expansion coefficient of the stranded wire.

* * * * *